US005391832A

United States Patent [19]

Lace

[11] Patent Number: 5,391,832

[45] Date of Patent: Feb. 21, 1995

[54] ELECTROMAGNETIC MUSICAL PICKUP WITH WRAPAROUND PERMANENT MAGNET

[75] Inventor: Melvin A. Lace, Prospect Heights, Ill.

[73] Assignee: Thomas E. Dorn, Clarendon Hills, Ill. ; a part interest

[21] Appl. No.: 90,319

[22] Filed: Jul. 13, 1993

Related U.S. Application Data

[63] Continuation-in-part of Ser. No. 202, Jan. 4, 1993, which is a continuation-in-part of Ser. No. 764,346, Sep. 23, 1991, abandoned, and Ser. No. 900,485, Jun. 18, 1992, Pat. No. 5,221,805, said Ser. No. 764,346, said Ser. No. 900,485, is a continuation-in-part of Ser. No. 597,899, Oct. 10, 1990, abandoned.

[51] Int. Cl.[6] ..... G10H 3/18

[52] U.S. Cl. ..... 84/726

[58] Field of Search ..... 84/723, 725, 726, 728

[56] References Cited

U.S. PATENT DOCUMENTS 4,320,681 3/1982 Altilio .
4,809,578 3/1989 Lace, Jr. .
4,878,412 11/1989 Resnick ..... 84/726
5,168,117 12/1992 Anderson ..... 84/726
5,221,805 6/1993 Lace ..... 84/726

*Primary Examiner*—William M. Shoop, Jr.
*Assistant Examiner*—Jeffrey W. Donels
*Attorney, Agent, or Firm*—Dorn, McEachran, Jambor & Keating

[57] ABSTRACT

An electromagnetic pickup assembly for a musical instrument, such as a guitar, strung with ferromagnetic strings, comprises an elongated high permeability ferromagnetic (steel or iron) core long enough to span all of the strings. An elongated, annular electrically conductive pickup coil is wound in a coil form, usually plastic, that encompasses the core. An elongated, unitary, annular permanent magnet closely encompasses all sides of the coil; it is transversely magnetized to maintain the core and the coil in a magnetic field of a given polarity. There is no permanent magnet engaging the core. A housing or other mounting is used to mount the core, the coil, and the permanent magnet in spaced relation to the strings so that the pickup generates a magnetic field that encompasses all of the strings, whereby movement of any string or combination of strings generates electrical signals in the coils. The housing may include a steel shell around the permanent magnet.

8 Claims, 2 Drawing Sheets

FIG. 4
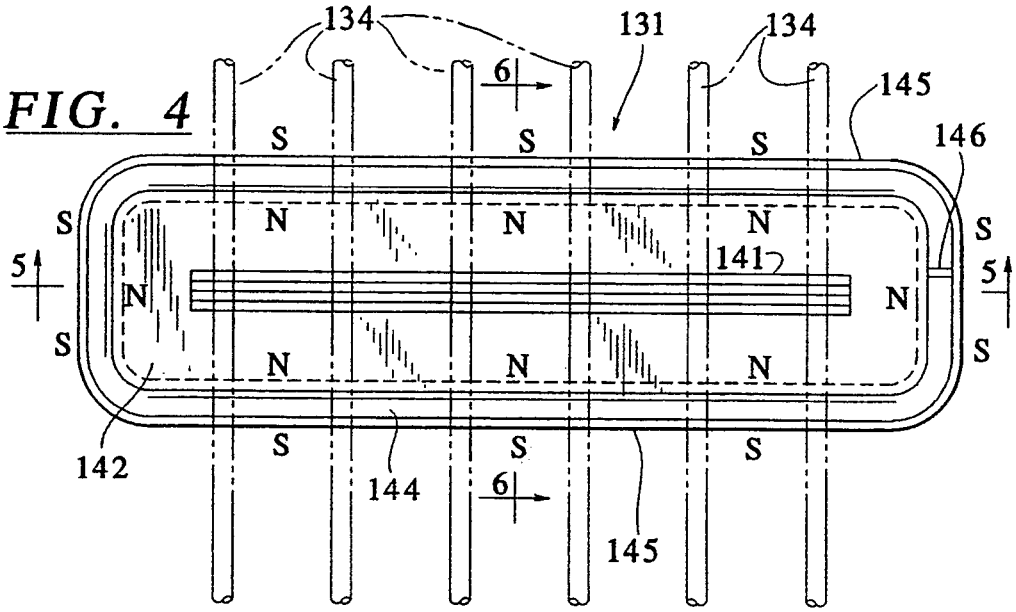
FIG. 5
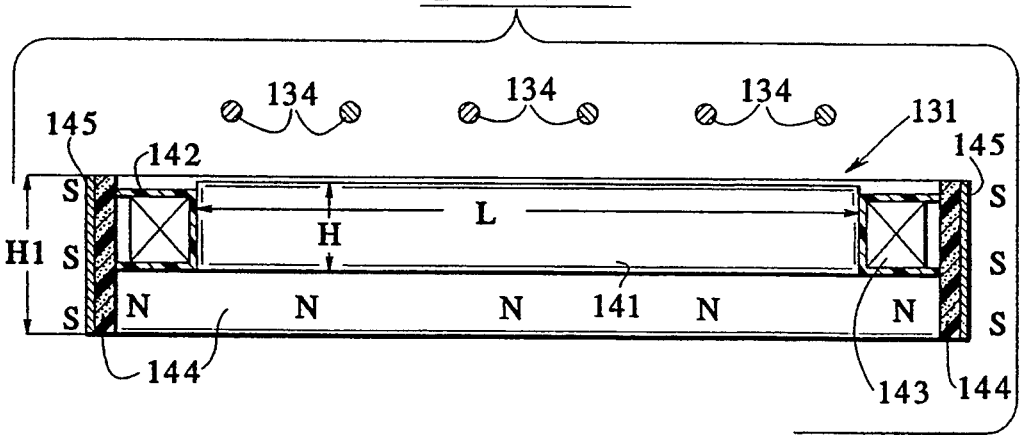
FIG. 6
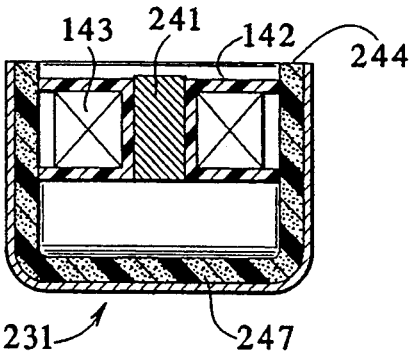
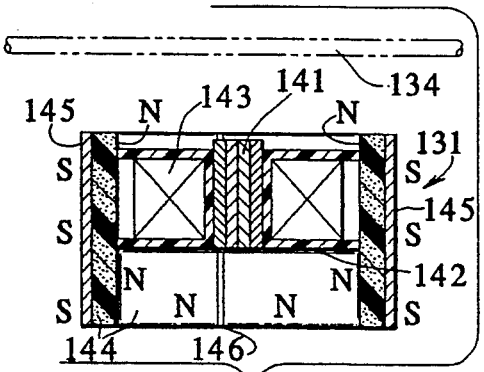
FIG. 7

ELECTROMAGNETIC MUSICAL PICKUP WITH WRAPAROUND PERMANENT MAGNET

This application is a continuation-in-part of application Ser. No. 08/000,202 filed Jan. 4, 1993, which was a continuation-in-part of two prior applications, Ser. Nos. 07/764,346 filed Sep. 23, 1991 and 07/900,485 filed Jun. 18, 1992 now U.S. Pat. No. 5,221,805; those two applications were continuations-in-part of another prior application, Ser. No. 07/597,899 filed Oct. 10, 1990. Applications Ser. Nos. 07/764,346 and 07/597,899 have been abandoned.

BACKGROUND OF THE INVENTION

For many years, electromagnetic signal pickups have been utilized on musical instruments having ferromagnetic strings. Such pickups have been employed with guitars, bass guitars, banjos, mandolins, violins and a variety of other instruments. A pickup for a musical instrument that uses ferromagnetic strings almost invariably incorporates a magnetic structure for generating a magnetic field that encompasses the strings. That magnetic structure usually includes at least one permanent magnet and may include at least one high-permeability ferromagnetic pole piece. Frequently, the pickup has a separate pole piece or permanent magnet for each string; thus, a guitar pickup may have six pole pieces or six magnets, one for each string. On the other hand, some electromagnetic pickups have a single pole piece that spans a number of strings, often all of the strings of the instrument. The pickup may have an electrical pickup coil for each string, or it may have one electrical pickup coil that generates a composite all-string signal.

The electrical signals from the coil or coils are amplified and reproduced by a speaker or other transducer that functions as the output of the musical instrument. The electrical pickup coils are customarily disposed in encompassing relation to the magnetic cores; when there are plural coils each coil usually has its own core. This electromagnetic structure is fitted into a housing that may or may not be a part of the magnetic structure. Whether or not it is a part of the magnetic structure, a principal purpose of the housing is to protect the pickup from dirt and other contaminants and to mount the pickup on the instrument.

A wide variety of individual constructions have been used for electromagnetic pickups employed with musical instruments such as guitars. Frequently, the efforts of the pickup designer have been directed toward achieving an output signal from the electrical coil that is as close as possible to a faithful reproduction of the sound that would be developed by the instrument functioning as an acoustical device. This is not always the case, however; many electromagnetic pickups have been designed to give a particular distortion deemed desirable by the designer or by a musician.

For electromagnetic pickups in general, as applied to musical instruments having steel or other ferromagnetic strings, there may be some difficulty in obtaining an output signal of sufficient amplitude. This may be a minor problem, with modern electronic technology, because even a very weak signal can often be amplified to an adequate amplitude. On the other hand, a reasonable output amplitude from the pickup itself is desirable because it reduces the necessity for subsequent amplification, and thus reduces the likelihood of inadequately controlled distortion. Moreover, with adequate initial amplitude of the signal generated by the pickup, the signal-to-noise ratio is increased so that a "purer" signal can be realized.

A pronounced problem, in many electromagnetic pickups for musical instruments, has to do with the frequency response. The overall "sound" derived from the output signal is usually critical to the requirements of the musician. Some musicians want to have the output signal as close as possible to the acoustic output of the instrument, at least in theory. Others, however, want to have a distortion that is acceptable to them, one that represents their own concept or technique for interpretation of music. The frequency response characteristics of the pickup are critical in this regard. A similar situation is presented by the sound characteristic known to musicians as "sustain"; sometimes accented "sustain" is desirable in the view of the musician using the pickup and sometimes it is not.

SUMMARY OF THE INVENTION

It is a primary object of the invention, therefore, to provide a new and improved inexpensive electromagnetic pickup, for a musical instrument having a plurality of ferromagnetic strings, which affords a favorable signal-to-noise ratio and that can generate signals having a broad range of frequency and "sustain" characteristics.

Another object of the invention is to provide a new and improved electromagnetic pickup for a plural ferromagnetic stringed instrument, particularly a guitar, that is quite simple and inexpensive in construction, including only a core, a coil, and one wraparound permanent magnet, yet that can be readily mounted upon the guitar and has a virtually indefinite life.

Accordingly, the invention relates to an electromagnetic pickup for a musical instrument, such as a guitar, having a plurality of ferromagnetic strings disposed in substantially co-planar spaced relation to each other over a predetermined span S; the pickup comprises an elongated ferromagnetic core, having a length L at least about as large as S and a substantially smaller height, and an elongated, annular, electrically conductive pickup coil disposed in encompassing relation to the core. An elongated, unitary, annular permanent magnet is disposed in closely adjacent encompassing relation to all sides of the pickup coil, magnetized in a transverse direction; the permanent magnet maintains the core and the coil immersed in a magnetic field of a given constant polarity. There is no permanent magnet located immediately above the top or immediately below the bottom of the core. Housing means, encompassing the core, the coil, and the permanent magnet, are provided for mounting the pickup on the musical instrument with the core and the coil spanning the ferromagnetic strings in spaced relation thereto and with all strings passing through a magnetic field afforded by the permanent magnet means and the core so that movement of any string (or combination of strings) generates an electrical signal in the coil.

BRIEF DESCRIPTION OF THE DRAWINGS

FIG. 4 is a plan view, with the housing omitted, of an electromagnetic musical pickup, specifically a pickup for a six-string guitar, constructed in accordance with one embodiment of the invention;

FIG. 5 is a longitudinal sectional view taken approximately along line 5—5 in FIG. 4;

FIG. 6 is a transverse sectional view taken approximately along line 6—6 in FIG. 4; and FIG. 7 is a transverse sectional view, like FIG. 6, of a modification of the invention.

DESCRIPTION OF THE PREFERRED EMBODIMENTS

Figure 1:
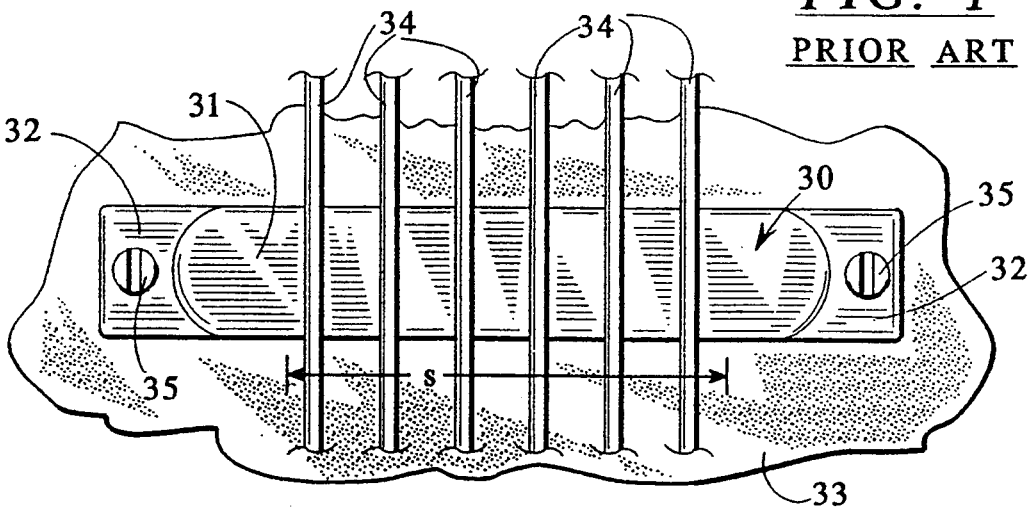
FIG. 1 PRIOR ART
FIG. 1 is a plan view of an electromagnetic musical pickup, specifically a guitar pickup, of the kind to which the invention is directed.
Figure 2:
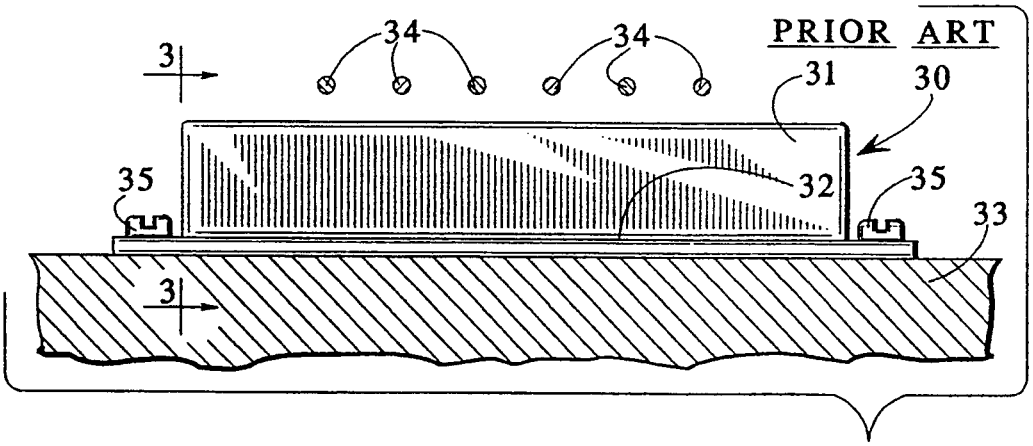
PRIOR ART FIG. 2
FIG. 2 is a side elevation view of the apparatus of FIG. 1.
Figure 3:
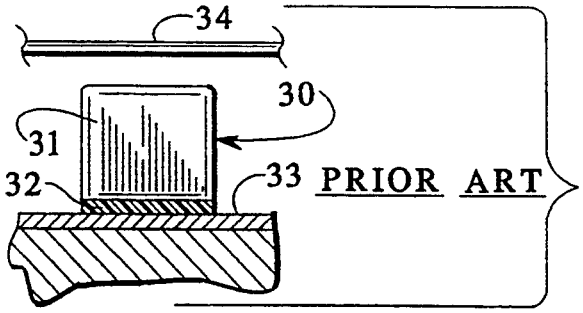
PRIOR ART FIG. 3
FIG. 3 is a section view taken approximately along line 3—3 in FIG. 2.

FIGS. 1–3 illustrate an electromagnetic guitar pickup 30 that may be deemed generally representative of prior art pickups but that also applies generally to the electromagnetic musical pickups of the present invention. Typically, pickup 30 comprises a housing 31 having a base plate 32 that may be integral with the housing. Housing 31 may be made of steel or of a permanent magnet material if it is used as an operating component of pickup 30; the housing may be of a magnetically inert plastic if it is not a working electromagnetic component of the pickup. Pickup 30 is mounted on the top 33 of a musical instrument having a plurality of ferromagnetic strings 34. As illustrated, strings 34 are the strings of a guitar and extend across but in spaced relation to the top surface 33 of the guitar neck or body, depending upon where the pickup 30 is mounted. Strings 34 are distributed across a total span S, FIG. 1, usually with approximately equal spacing between the strings. Screws or other appropriate mounting devices 35 are utilized to mount pickup 30 on guitar body 33.

A wide variety of different electromagnetic sensing devices have been utilized in prior art embodiments of pickup 30; consequently, no specific pickup structure is shown in FIGS. 1–3. On the other hand, it may be noted that any known construction for electromagnetic pickup 30 would include a magnetic structure for generating a magnetic field that encompasses the ferromagnetic strings 34. A structure of this sort, in any of the known prior art devices, customarily includes at least one permanent magnet and may include at least one high permeability ferromagnetic pole piece. For the electromagnetic pickup 30 shown in FIGS. 1–3, utilizing known constructions, there could be six pole pieces, or six magnets, one for each string 34. On the other hand, some forms of electromagnetic pickup have utilized a single pole piece or core that extends the length of the pickup, beneath all of the musical strings 34.

In any of the known forms of electromagnetic pickup there is at least one electrical pickup coil, not shown in FIGS. 1–3; there may be separate coils for each of the strings 34, usually with all of those coils electrically connected together. The entire pickup construction, including the pole piece or pieces, the permanent magnet or magnets, and the electrical pickup coil or coils, is disposed in housing 31. Vibrations of the musical instrument strings 34, both vertically and horizontally, generate electrical signals in the coil or coils within housing 31, and it is those signals that are amplified and reproduced, as by one or more speakers, to afford an output from the musical instrument in conventional manner.

FIGS. 4–6 illustrate the operating components of an electromagnetic musical pickup 131 constructed in accordance with one embodiment of the present invention. Pickup 131 includes an elongated, high permeability ferromagnetic core 141 that extends for a length L that is sufficient to span all of the strings 134. In this instance, it is assumed that pickup 131 is used for a six string guitar. As illustrated, there are four thin sheet steel laminations in core 141. The number of laminations may vary; typically, two to eight thin steel laminations may be utilized. A solid, unlaminated ferromagnetic member may also be employed. A coil form or bobbin 142 is mounted on and encompasses the ferromagnetic core 141; an electrically conductive pickup coil 143 (FIGS. 5 and 6) is mounted in coil form 142, thus being disposed in encompassing relation to core 141. Pickup coil 143 generates an electrical signal representative of movements of any of the strings 134 or any combination of those strings.

Pickup 131 further includes an elongated, annular, unitary wrapareound permanent magnet 144. Permanent magnet 144 is transversely magnetized so that its inner surface, facing core 141 (and coil 143) is a continuous north pole; it could as well be a continuous south pole, so long as core 141 and coil 143 are immersed in a magnetic field of one polarity. There is no permanent magnet immediately above core 141; moreover, there is no permanent magnet immediately below the core. The permanent magnet 144 preferably has a height H1 (FIG. 5) substantially larger than the core height H. Preferably, H1 is about twice H.

Pickup 131, as thus far described, is complete and operable. Moreover, it is much less expensive than conventional pickups, because the working components of the pickup are simple and inexpensive, there are a minimum number of components (core 141, bobbin 142, coil 143, and magnet 144), and assembly operations are short, simple, and minimal. Of course, some kind of housing is needed to hold the parts together; a simple external retaining band 145 around the outside of the pickup will suffice, as shown in FIGS. 4–6, perhaps with a base (not shown) like base 32, FIGS. 1–3. The retaining band or housing member 145 may be of plastic or other material, so that it is not a working component of electromagnetic pickup 131. On the other hand, a steel band 145 may be used, in which case it constitutes a working member of the electromagnetic pickup.

Permanent magnet 144 may be formed, as by pressure molding, into a continuous, elongated annulus. Alternatively, the permanent magnet may constitute a strip of permanent magnet material bent into the desired long, annular shape. In the latter instance there may be a gap 146 in permanent magnet 144; see FIGS. 4 and 6.

FIG. 7 is a cross-sectional view, like FIG. 6, of another embodiment of the invention constituting a pickup 231. Pickup 231 has a solid, high permeability core 241 that is otherwise like core 141. As before, the core is surrounded by a coil 143 in a bobbin 142. Moreover, the core 241 and coil 143 are encompassed by an elongated, unitary, annular permanent magnet 244 that is essentially similar to the permanent magnet 144 of FIGS. 4–6 except that magnet 244 is cup-shaped, with a bottom 247. The bottom 247 of permanent magnet 244 is preferably displaced a substantial distance from core 241, as shown. The operating components 143, 241, and 244 of pickup 231 are preferably all mounted in a cup-shaped shell or housing 245. Housing 245 may be of plastic; preferably, it is made of sheet steel. Housing 245 may have a base (not shown) like base 32 of FIGS. 1"3 for mounting pickup 231 on an instrument.

The preferred permanent material for either of the permanent magnets 144 or 244 comprises a resin, preferably relatively flexible and slightly elastomeric, that is impregnated with a particular low energy product permanent magnet material. Such permanent magnet resins are readily available commercially as sheets and as moldable compositions or molded members. One form of appropriate flexible permanent magnet resin material is made and sold by 3M Company under the trademark PLASTIFORM; another flexible resin permanent magnet material that may be utilized in either of the pickups 131 and 231 is sold by B. F. Goodrich Company under the trademark KOROSEAL. Yet another such material is available from The Electrodyne Company of Batavia, Ohio under the designation PLASTALLOY. All of these permanent magnet materials have moderate induction levels (moderate maximum energy products) in the range of $1.1\times10^6$ to $1.9\times10^6$. These permanent magnet materials are quite adequate for the permanent magnets 144 and 244; they are also quite inexpensive.

The permanent magnets 144 and 244 may also be substantially stronger, magnetically; thus, either may have an induction level or maximum energy product that is substantially higher than provided by the materials identified above. A commercially available material comprising an elastomeric resin and magnetic particle complex that has a high maximum energy product, at least $3\times10^6$ is available from The Electrodyne Company of Batavia, Ohio, under the designation REANCE 90. That is not the preferred material for magnets 144 and 244 because of rather high cost, but it can be used.

The preferred wire size for coil 143 is forty four gauge or larger copper wire. Larger wire sizes result in better high frequency response. A range of 36 to 45 gauge is preferred. For a laminated core such as core 141, No. 1008 steel is quite satisfactory; other steels or other ferromagnetic materials can be used. No. 1008 steel can also be used for members 145 and 245.

The electromechanical musical pickups 131 and 231 of FIGS. 4–7 produce output signals of usable amplitude, though the amplitude may be lower than that obtainable with some other pickups. The output of coil 143 exhibits an excellent signal-to-noise ratio. Hum pickup from external sixty Hertz fields and the like is virtually non-existent; the output signals from coil 143 are not distorted by such hum.

All of the materials employed in pickup 131 are commercially available, although coil 143 is usually wound to particular specifications and the dimensions of the laminations used in core 141 must also be established. Typically, the core laminations in a guitar pickup, using No. 1008 steel, may have a length L of 2.0 inches (5.08 cm), a height H of 0.34 inch (0.86 cm) and a thickness of 0.02 to 0.025 inch (0.125 cm). Typically, the permanent magnets 144 and 244 are 0.03 inch (0.075 cm) in thickness, whether molded or of strip configuration. The cup-shaped components 244 and 245 increase the cost of pickup 231 relative to pickup 131, but pickup 231 is still much less expensive than virtually any known device.

I claim:

1. An electromagnetic pickup for a musical instrument, such as a guitar, having a plurality of ferromagnetic strings disposed in substantially co-planar spaced relation to each other over a predetermined span S, the pickup comprising:

an elongated ferromagnetic core, having a length L at least about as large as S and a smaller height;

an elongated, annular, electrically conductive pickup coil disposed in encompassing relation to the core;

an elongated, unitary, annular permanent magnet, disposed in closely adjacent encompassing relation to all sides of the pickup coil, magnetized in a transverse direction, for maintaining the core and the coil in a magnetic field of a given constant polarity, with no permanent magnet located immediately above the top or immediately below the bottom of the core;

and housing means, encompassing the core, the coil, and the permanent magnet means, for mounting the pickup on the musical instrument with the core and the coil spanning the ferromagnetic strings in spaced relation thereto and with the strings passing through a magnetic field afforded by the permanent magnet means and the core so that movement of any string or combination of strings generates an electrical signal in the coil.

2. An electromagnetic pickup for a ferromagnetic string musical instrument, according to claim 1, in which the permanent magnet is formed of a flexible strip of resin impregnated with a particulate permanent magnet material, bent into an elongated annular shape.

3. An electromagnetic pickup for a ferromagnetic string musical instrument, according to claim 1, in which the housing means includes a thin steel shell encompassing the permanent magnet.

4. An electromagnetic pickup for a ferromagnetic string musical instrument, according to claim 1, in which the permanent magnet has a height about twice the height of the core.

5. An electromagnetic pickup for a ferromagnetic string musical instrument, according to claim 4, in which the permanent magnet is a unitary molded member of elongated cup-shaped configuration with the bottom of the cup displaced a substantial distance from the core and the coil.

6. An electromagnetic pickup for a ferromagnetic string musical instrument, according to claim 5, in which the housing means includes a thin, cup-shaped steel shell encompassing the permanent magnet.

7. An electromagnetic pickup for a ferromagnetic string musical instrument, according to claim 1, in which the core includes a plurality of ferromagnetic sheet steel laminations each having a thickness no greater than about 0.025 inch (0.06 cm).

8. An electromagnetic pickup for a ferromagnetic string musical instrument, according to claim 1, in which the electrical pickup coil is formed of 45 gauge or larger copper wire.

* * * * *